US005271483A

United States Patent [19]

Hong

[11] Patent Number: 5,271,483

[45] Date of Patent: Dec. 21, 1993

[54] APPARATUS FOR LIFTING FALSE FLOOR IN SWIMMING POOL

[76] Inventor: Young K. Hong, 27-1 Tsukakosi 5-chome, Waraba-shi, Saidama-ken, Japan

[21] Appl. No.: 984,493

[22] Filed: Dec. 2, 1992

[51] Int. Cl.[5] ..... B66B 9/00

[52] U.S. Cl. ..... 187/1 R; 52/169.7; 52/126.5

[58] Field of Search ..... 187/1 R, 8.59, 20; 52/126.1, 126.5, 169.7, 169.1

[56] References Cited

U.S. PATENT DOCUMENTS 5,119,906 6/1992 Kondratuk ..... 187/8.59

FOREIGN PATENT DOCUMENTS 63-01672 3/1988 Japan ..... 52/169.7
63-58994 11/1988 Japan .
2-45239 3/1990 Japan .
2-45240 3/1990 Japan .
153173 6/1990 Japan ..... 52/169.7

*Primary Examiner*—Robert P. Olszewski
*Assistant Examiner*—Kenneth Noland
*Attorney, Agent, or Firm*—Nixon & Vanderhye

[57] ABSTRACT

The present invention relates to a pool where a false floor is horizontally arranged and a plurality of longitudinal grooves are installed within the inside-walls of a pool, and lifting units are equipped in each longitudinal grooves to lift a false floor. A lifting apparatus installs a pair of shafts of rotation movement at the top and bottom of a pillar body which is installed within each longitudinal grooves, places a sprocket and a pulley in juxtaposition to each shafts of rotation movement to freely rotate, suspends a chain on a pair of sprockets, suspends a wirerope on a pair of pulleys, fixes the chain and the wirerope to the arm of a false floor which is projected toward the longitudinal groove, rotates a driving sprocket by a motor to drive the chain which is engaged thereto, thereby lifting the false floor, and vertically moves the wirerope in accordance with a lifting of the false floor and fixes it by a wirerope fixing element to maintain a false floor during the stop of it.

4 Claims, 7 Drawing Sheets

APPARATUS FOR LIFTING FALSE FLOOR IN SWIMMING POOL

BACKGROUND OF THE INVENTION

The present invention relates to an apparatus for lifting a false floor, which sinks a false floor in a pool and vertically moves it to adjust the depth of water, keeping its horizontality.

It is desirable to adjust the depth of water in a swimming pool to stature of a swimmer. Accordingly, it is necessary to adjust the depth of water to the user's height age because the staure is different from the junior class to the senior class.

Recently, because of this, an apparatus for lifting a large false floor has been used, which sinks a false floor in a pool and vertically moves four corners of it by using a chain or a wirerope which is driven by a motor to adjust a depth of water, keeping its horizontality.

The lifting apparatus equipped the pantograph type jack below a false floor in order to lift the apparatus up as well as support the load of swimmers and, when the water is drained from the pool, the load of the false floor hanging in the air.

The method using a chain is disclosed in Japanese Patent Sho 63-58994, the method using a wirerope in Japanese Utility model Phyung 2-45239 and a pantograph type jack in Japanese Utility model Phyung 2-45240, respectively.

The method using a chain to lift a false floor controls the rotation of a sprocket which moves a chain above and below and easily vertically adjusts the false floor little by little. However, because the tension of a chain is not enough to bear a load of a false floor when the water in a pool is drained, the supporting equipment such as a jack must be installed under a false floor.

And, in the case where a wirerope is used for lifting a false floor, the tension of a wirerope is stronger than that of a chain so that it is possible to lift a false floor hanging at the air. However, though lifting units are equipped in four corners of a pool, it is difficult to precisely adjust a false above and below only by controlling rotation of each drum.

On the other hand, a pantograph jack for supporting a load of a false floor is most efficient when it is fully extended. But, when it is not fully extended, its supporting force is insufficient.

Furthermore, in the case where a pantograph jack is used for lifting a false floor, it needs an enough space for installing a pantograph jack between the floor surface of a pool and a false floor, so that a depth of water was shallowed as much.

SUMMARY OF THE INVENTION

It is an object of the present invention to provide an apparatus for lifting a false floor by more simple and efficient lifting unit using both of a chain and a wirerope.

There is provided an apparatus for lifting a false floor, in which a false floor is horizontally installed inside a pool and longitudinal grooves are installed in the inside-walls of a pool, and lifting units are equipped in each longitudinal grooves, characterized in that which comprises a pair of sprockets and a pair of pulleys which are equipped to horizontal rotation shafts at the top and bottom of each lifting units installed in each longitudinal grooves; a chain which is suspended on a pair of sprockets, a wirerope which is suspended on a pair of pulleys, the chain and the wirerope being fixed to the arm of a false floor which is projected toward the longitudinal groove; a driving sprocket which is rotated by a motor to drive said chain which is engaged thereto, thereby lifting the false floor, and said wirerope being vertically moved in accordance with a lifting of said false floor and fixed during the stop of it.

A ratchet wheel is fixed to an upper pulley installed inside each longitudinal grooves, a wirerope suspending a false floor is linked to a lower pulley by winding one and a half times from the lower side of a pulley groove, and said pulley groove is the V-shape of round ground of which the diameter is somewhat larger than that of a wirerope, the depth is two times larger than the diameter of the wirerope, and the top width is two times larger than the diameter of said wirerope.

And a fixing means such as the ratchet wheel is equipped in order to fixedly stop the rotation of a pulley and also a fixing means for fixing a wirerope is provided.

The operating system of above mentioned apparatus releases a wirerope fixing element and a pawl of a ratchet wheel of a pulley to make a wirerope free and simultaneously operates all lifting units of each longitudinal grooves to make a precise lifting control of a false floor by driving a chain and then lifts the false floor while keeping its horizontality.

Then, an apparatus engages a pawl of a ratchet wheel to an upper pulley in order to prevent it from rotating in the falling direction of a false floor, if the false floor is positioned at the desired height.

Next, an apparatus make a wirerope fixing element fix a wirerope and relaxes a chain to make a wirerope sustain a load of a flase floor.

BRIEF DESCRIPTION OF THE INVENTION

Other objects and aspects of the invention will become apparent from the following description of the embodiment with reference to the accompanying drawings in which.

DETAILED DESCRIPTION OF THE INVENTION

Figure 1:
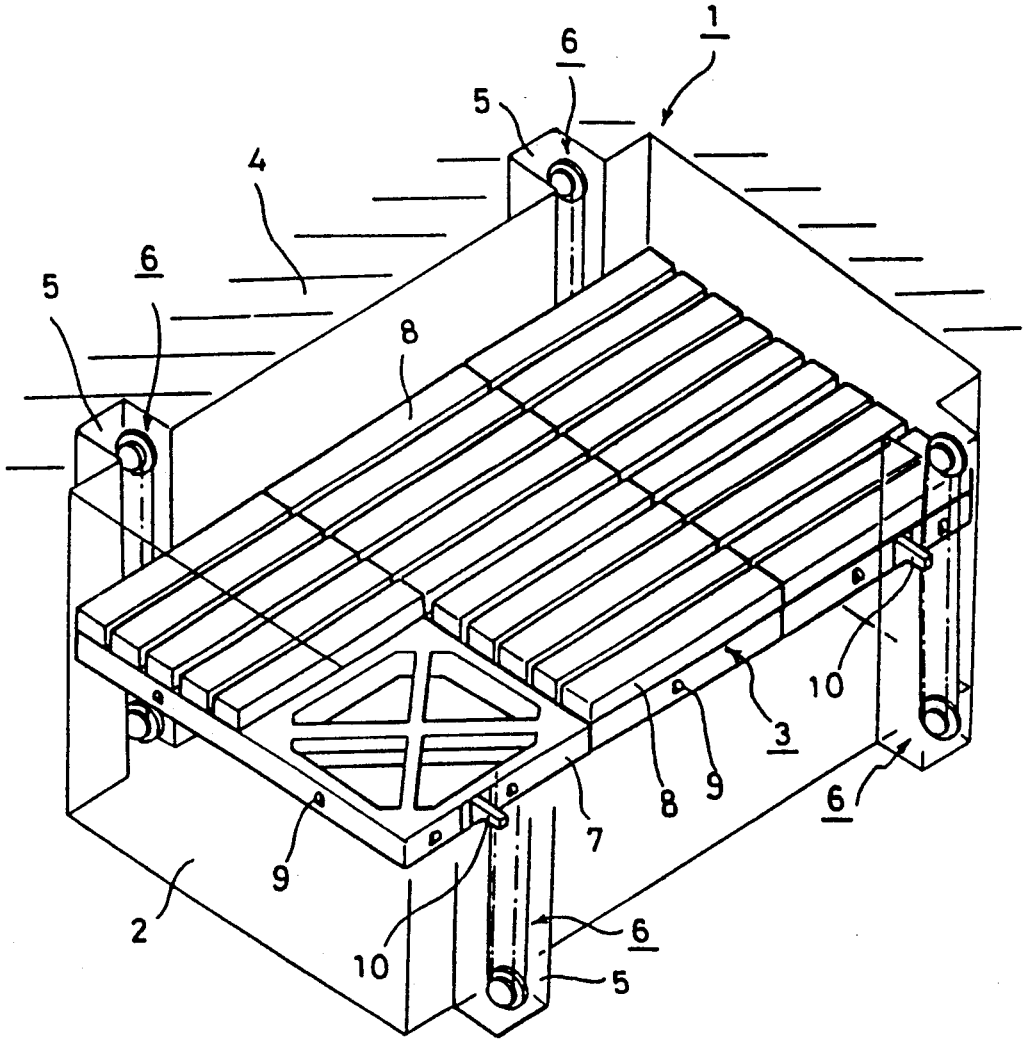
FIG. 1 is a perspective view of a pool in which an apparatus for lifting a false floor of the present invention is installed.

FIG. 1 is a perspective view of a pool in which an apparatus for lifting a false floor is installed.

The pool 1 has the square floor 2 and the false floor 3 which is somewhat smaller than a floor 2 is horizontally placed inside the pool 1.

The longitudinal grooves 5 with a horizontal section of a square is provided in a pool wall in both corners of the pool side 4 and the height of the longitudinal groove 5 is a distance from the floor surface 2 to the pool side 4 and the lifting unit 6 is installed inside the longitudinal groove 5 and the flase floor 3 is lifted by four lifting units.

The false floor 3 consists of the frame 7 and the deck 8. The frame 7 is made of a steel material which applys antiseptic treatment and the outer thereof is a square and the inner thereof is a lattice type, and a strengthening bar is tiltly joined to a lattice part in order to strongly maintain a floor surface 2 without relaxation. The roller which vertically rotates is fixed to each outers of the frames 7 and is closed to a pool wall to smoothly lift the false floor 3. The deck 8 with a bamboo blind shape attached on the frame 7 makes the water of the pool 1 circulate easily above and below and makes the false floor 3 smoothly lift under the water. The deck 8 which is made of a synthetic resin generates buoyancy to decrease a weight of the flase floor 3 including the frame 7 under the water. The specific gravity of a false floor becomes somewhat bigger than 1, thereby singking the false floor 3 under the water.

The deck 8 has an access door, which is not shown in drawings, in order to inspect a pool or to sweep scrubbing materials on the floor surface 2.

The projected arm 10 which is horizontally projected toward the longitudinal groove 5 is fixed to the outer part of the frame 7 which is closed to the longitudinal groove 5 and is also linked to the lifting unit 6 in the longitudinal groove 5.

Accordingly, the false floor is lifted by lifting units installed within each longitudinal grooves where the projected arms which are fixed to the frames 7 of four corners are installed.

Figure 2:
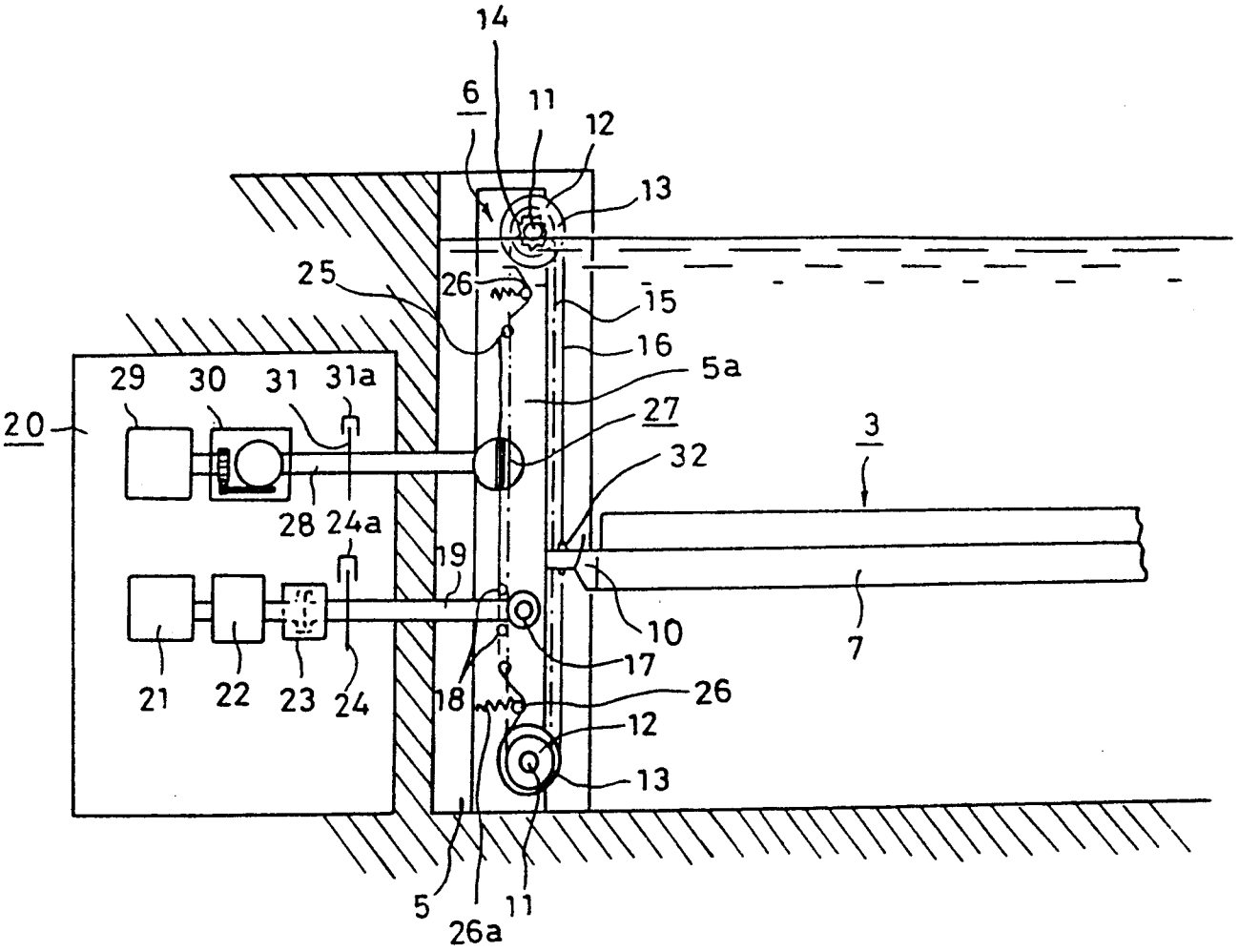
FIG. 2 is a side view of a pool in which a lifting false floor is installed.

FIG. 2 is a side view of a pool in which a lifting false floor is installed. In the lifting unit 6, the shafts 11 are equipped in parallel each other in the top and bottom of the pillar body 5*a* which is vertically installed in the longitudinal groove 5 and the sprocket 12 and the pulley 13 are placed to each shafts 11, and the ratchet wheel 14 is fixed to the pulley 13. The sprocket 12 and the pulley 13 are able to independently and freely rotate each other. The chain 15 shown by one dotted line is installed between the upper and the lower sprockets 12 and the wirerope 16 is installed between the pulleys 13.

The material of the wirerope 16 is not restricted to a steel rope, rather a rope which contains a chemical fiber may be used if a chemical fiber has an eminent endurance of a tension load. The chain which is located toward a pool is fixed to the end of the projected arm 10 of the frame 7. Herein, the chain may have only tension endurance that is enough to lift the false floor 3 under the water, because the role of the chain is only to lift the false floor 3 under the water.

The sub-sprockets 18 are placed in the upper and lower sides of the shaft 19 between the driving sprocket 17 and the chain 15 which is placed in the inside the longitudinal groove 5, and the false floor 3 is precisely by lifted certainly driving the chain 15 with the sub-sprocket 18.

The waterproof driving shaft 19 of the waterproof driving sprocket 17 stretches from the longitudinal groove 5 to the machinery room 20 which is closed to the longitudinal groove 5. The motor 21 is installed in the machinery room 20, of which the rotation speed is reduced by the speed reducer 22 and the motor 21 is connected to the driving shaft 19 through the torque limiter 23. The torque limiter 23 is slided in order not to transfer the rotation to the motor 21 any more, if the torque more than the regulation value is transferred to the driving shaft 19.

Although, the driving sprocket 17 is installed independent of with the upper and lower sprockets 18 according to the invention, the method driving one of the upper and lower sprockets 18 also may be used.

The sprocket 24 for detecting the rotation is linked to the driving shaft 19 and the rotation movement of the detecting disc which is connected to the sprocket 24 for detecting the rotation with a chain is detected by the sensor 24*a*.

The state of the rotation of the driving shaft 19 is detected as the electric signal by the sensor 24*a* to transfer to the lifting control circuit to be mentioned below.

The lifting control circuit accurately detects the rotation of the driving shaft 19 and senses the minute movement of the false floor 3 connected to the chain 15 which moves above and below by the rotation of the driving shaft 19.

The chain 15 moves the projected arm 10 in the upper or lower direction by the rotation of the driving sprocket 17 to lift the false floor 3.

In the wirerope inside the longitudinal groove 5, the sub pulleys 25 are equipped in connection with the wirerope 15 near the upper and lower pulleys 13 and the pressing pulleys 26 for pressing the wirerope 16 are respectively placed between each pulleys and each sub pulleys.

In the center of the wirerope 16 in the inside of the longitudinal groove 5, the wirerope fixing element 27 is installed and the driving shaft 28 of the waterproof wirerope fixing element 27 stretches to the machinery room 20. The motor 29 with the brake is installed in the machinery room 20 and connected to the driving shaft 28, of which the rotation speed is reduced by the speed reducer 30 through the worm gear.

The sprocket 31 for detecting the rotation of the driving shaft 28 is fixed to the shaft 28 and the rotation of the detecting disc which is connected to the detecting sprocket 31 with a chain which is not shown in drawing is detected by the sensor 31*a*. The sensor 31*a* detects the rotation of the driving shaft 28 as the electric signal to transfer to a lifting control circuit to be mentioned below.

Figure 3:
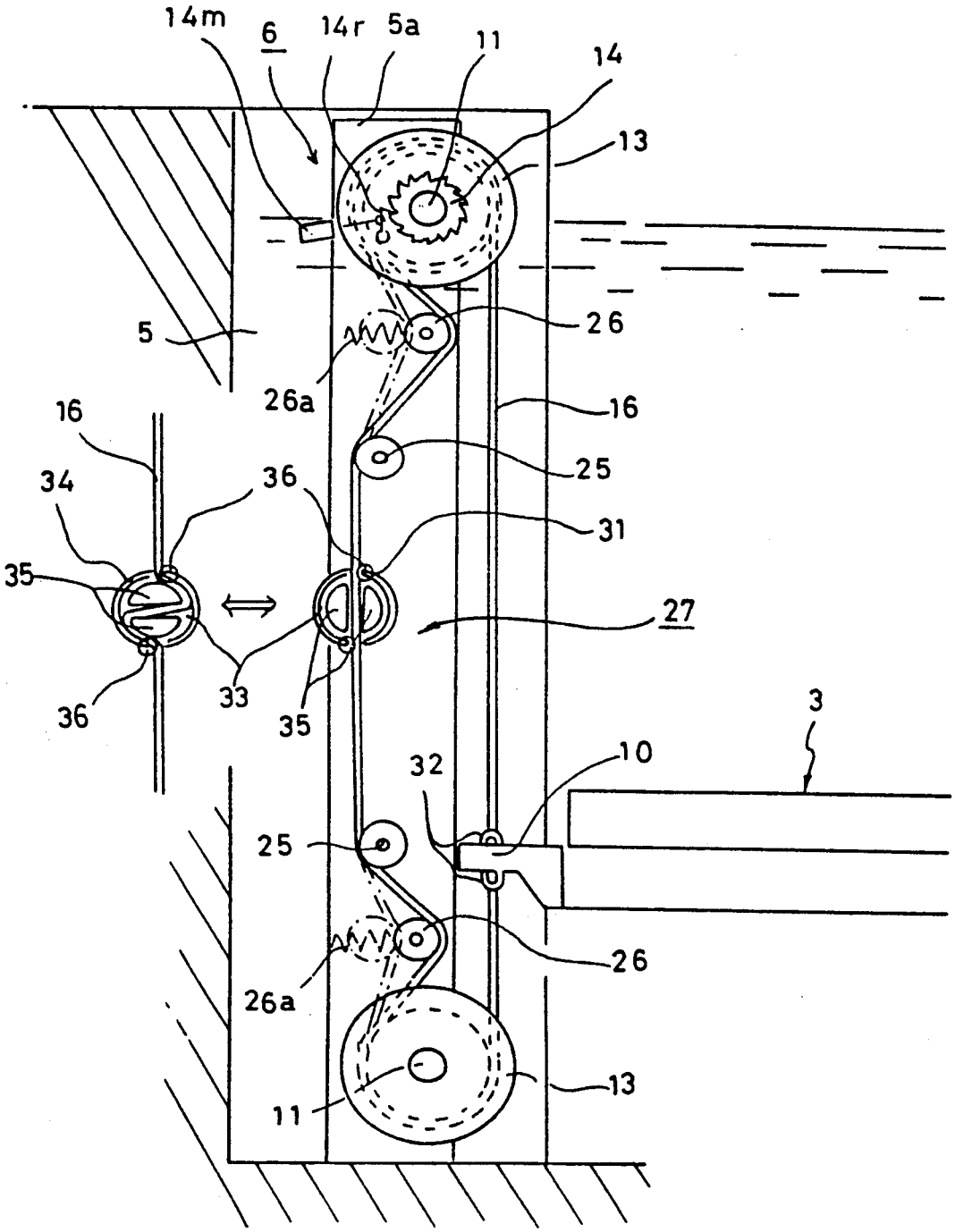
FIG. 3 is a view illustrating an example of the method for suspending a wirerope on a pulley.

FIG. 3 is a diagram illustrating an example of the method for suspending the wirerope on the pulley. The wirerope 16 is installed between the upper and lower pulleys 13 which freely rotate around the shafts 11 mounted on the top and bottom of the pillar body 5*a* in the longitudinal groove 5. The wirerope 16 which is placed toward the pool 1 is fixed to the U-shape brackets 32 in the top and bottom of the projected arm 10 of the false floor 3.

The ratchet wheel 14 is fixed to the upper pulley 13, on which the pawl 14*r* is mounted in order to prevent the pulley 13 from rotating in the descending direction of the false floor 3. The pawl 14*r* is controlled by the driving element 14*m* such as an electromagnetic unit and an air or oil pressure cylinder which is controlled by the lifting control circuit which is not shown in FIG. 3. The driving element 14*m* may be installed in the waterproof machinery room 20.

In the wirerope 16 which is placed in the side of the longitudinal groove 5, the pressing pulley 26 is placed under the shaft 11 of the upper pulley 13 and the pressing spring 26*a* is horizontally mounted on the pressing pulley 26 toward the pool 1, and the sub pulley 25 is placed under the pressing pulley 26 toward the inside of the longitudinal groove 5.

Similarly, the pressing pulley 26 is placed above the shaft 11 of the lower pulley 13 and the pressing spring 26a is horizontally mounted on the pressing pulley 26 toward the pool 1, and the sub pulley 25 is placed above the pressing pulley 26 toward the inside of the longitudinal groove 5.

The pressing force is given from the upper side of the wirerope 16 toward the inside of the longitudinal groove 5 between two pulleys 13 toward the pool 1 by the upper pressing pulley 26 and then is sequentially given toward the pool 1 by the lower pressing pulley 26 through the upper sub pulley 25, the central wirerope fixing element 27 and the lower sub pulley 25, so that the wirerope 16 is hung on the lower pulley 13. The wirerope fixing element 27 fixes the wirerope 16 by a tool to be mentioned below.

The wirerope fixing element 27 installed within the longitudinal groove 5 rotates the rotation movement part 33 by ¼ turn to fix the wirerope 16.

The rotation movement part 33 has two crescent-shaped bodies 35 which rotate in the circular wheel-shaped wall 34 having the vertical opening hole in the top and bottom. Thus, the wirerope 16 is passed through the rotation movement part 33 and if the wirerope 16 is fixed, the rotation movement part 33 is rotated by ¼ turn to tightly fix the wirerope between the inner surface of the circular-wheel wall 34 and the outer surface of the crescent-shaped body 35.

The sub pulleys 36 are installed in the rotation direction of the crescent-shaped bodies in the vertical opening holes of the top and bottom of the circular-wheel wall. The rotation movement of the rotation movement part 33 of the wirerope fixing element 27 is controlled by the motor 29 in the machinery room 20.

The rotation movement part 33 rotates by about ¼ turn to twist the wirerope 16 which is held between the two crescent-shaped bodies 35 in S-shape, so that the whole wirerope 16 becomes shorter and the tension load is forced to the upper and lower pressing pulleys 26 as much and the supporting force of the pressing pulley 26 which is applied by the pressing spring 26a is restored.

The wirerope 16 is set on the upper pulley 13 in such a way that it hangs the wirerope 16 on the upper pulley 13 from the pool 1 and then winds one and a half turns on the upper pulley 13. And the wirerope is winded on the lower pulley 13 by a half turn.

Besides, the wirerope fixing element 27 may drive the rotation movement part 33 with a clamp tool and in that case it may drive the clamp tool by the air pressure or oil pressure cylinder.

Figure 4:
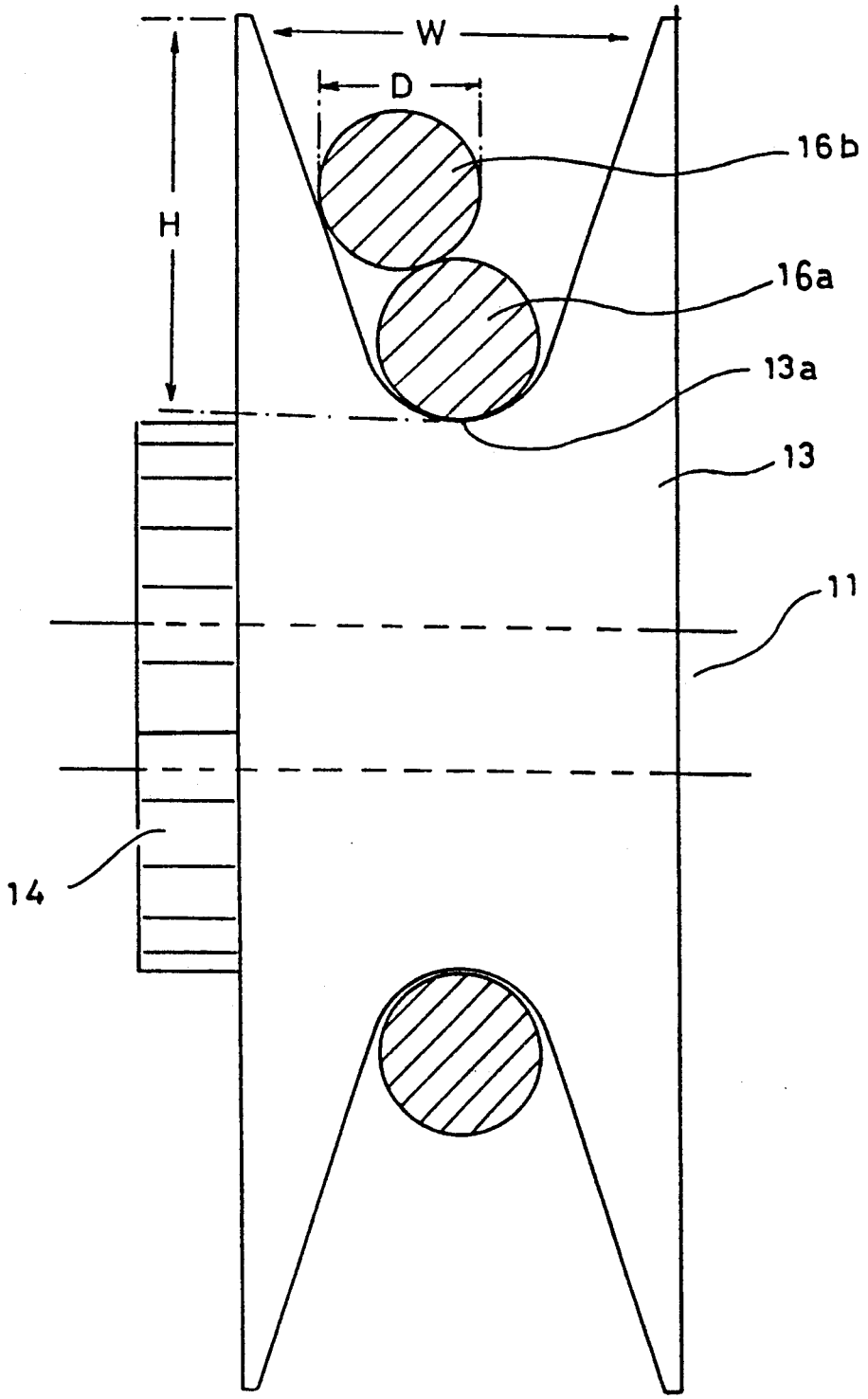
FIG. 4 is a vertical sectional view of a wirerope being suspended on an upper pulley.

FIG. 4 is a vertical sectional view of hanging a wirerope on an upper pulley. The ratchet wheel 14 is fixed to the pulley 13 which is fixed to the shaft 11 in order to freely rotate. The lower surface 13a of the pulley groove is round, ground of which the diameter is somewhat larger than that D of the wirerope 16 and the depth of the groove is two times as large as the diameter D of the wirerope 16. And the pulley groove is V-shaped with a round bottom, of which the width in the upper part W is two times larger than the diameter D of the wirerope 16.

Depending on the way how to wind the wirerope 16 on the upper pulley 13, it will be determined whether the first winding wirerope 16a is pressed tightly on the pulley 13 by the second winding wirerope 16b or not. Thus, the wirerope 16 must be wround properly. Thus, the wirerope 16a which suspends the projected arm 10 is placed on the lower surface 13a of the pulley groove and two wireropes are crossed at the point of the upper part W where the wireropes wind the pulley 13 by one turn. The wirerope 16b which is wound secondly on the pulley is located at the upper part of the pulley groove and links to the upper pressing pulley 26 with the form pressing the lower wirerope 16a.

The pressed force is the maximum under condition that the wirerope fixing element 27 is locked. In the case where the wirerope fixing element 27 and the pawl 14r of the ratchet wheel are free, though the pressed force is applied to the wirerope 16 which is installed between the upper and lower pulleys 13 by the pressing pulley 26, the wirerope 16 which is wound to the upper pulley 13 loosens somewhat and easily crosses each other at the intersection of two wireropes 16a and 16b because of less friction and the force pressing the lower wirerope 16a is not generated so much. Accordingly, under this condition, it is possible for the wirerope 16 to easily rotate between the both pulleys 13 when lifting the false floor 3.

But, if the wirerope 16 is fixed by the wirerope fixing element 27, it becomes taut and the wirerope 16 which is wound on the upper pulley 13 has a structure in that the second winding wirerope 16b tightly and fixedly presses the first winding wirerope 16a.

Also, the pawl 14r in the ratchet wheel 14 of the pulley 13 stops the rotation of the pulley 13 and supports the tension with the pulley 13, thereby distributing the tension to the wirerope fixing element 27.

If lifting the false floor 3 under the water, the lifting apparatus releases the pawl 14r of the ratchet wheel 14 of the upper pulley 13 and the wirerope fixing element 27 to make the wirerope 16 freely rotate and simultaneously the lifting apparatus the lifting units 6 of each longitudinal grooves 5 with the precise control by driving the chain to lift the false floor, while keeping its horizontality. And at the desired height of the flase floor 3, the lifting apparatus drives the driving element 14m to engage with the pawl 14r of the ratchet wheel 14 and prevent the upper pulley 13 from rotating in the descending direction of the false floor 3. Then the wirerope 16 which is wound round the upper pulley 13 by one and half turns is fixed at that position. Next, the lifting apparatus fixes the wirerope 16 by the wirerope fixing element 27 and rotates the driving sprocket 17 in the descending direction of the false floor 3, so that the load of the flase floor 3 suspending on the chain 14 is transferred to the wirerope 16.

Therefore, the upper pulley 13 is fixed by the ratchet wheel 14 and the wirerope 16 which is wound by one and half turns is pressed in such a configuration that the form that the wirerope 16a from the false floor and the wirerope 16b from the wirerope fixing element 27 are overlaped on the upper side of the upper pulley 13, so that it transfers the load of the false floor 3 to the shaft 11 of the pulley 13 and decreases the tension load of the wirerope 16 which the wirerope fixing element 27 must endure.

Accordingly, the wirerope fixing element 27 needs not sustain the whole load of the wirerope of the pool side.

Figure 5:
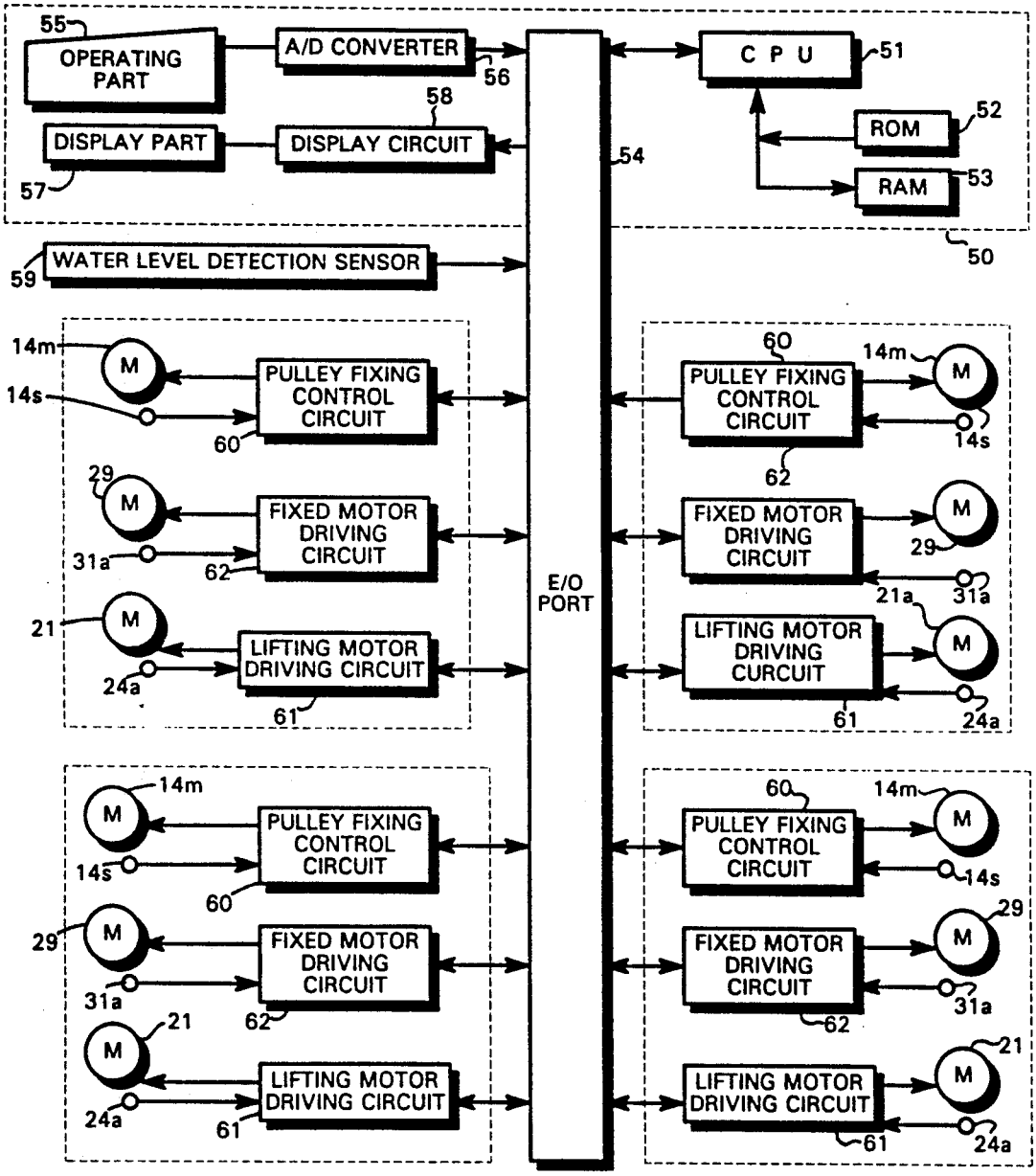
FIG. 5 is a schematic block diagram of a lifting apparatus using a computer in order to control a lifting of a false floor.

FIG. 5 is a schematic block diagram of an electric circuit of a lifting apparatus for controlling a lift of a false floor by using a computer according to the preferred embodiment of the invention.

The lifting control circuit is a basic configuration consisting of the central process unit (CPU) 51, the ROM 52, the RAM and the I/O port 54.

The I/O port 54 is connected to the operating part 55 of a control room through the analog to digital converter and to the display part 57 through the display circuit 58, respectively.

The sensor 59 for detecting the depth of water which is vertically installed in a pool from the floor surface to the top of a pool is connected to the I/O port 54 to apply the sensed depth of water in a pool to lifting control circuit 50.

The lifting unit which is installed in each longitudinal grooves consists of the pulley fixing control circuit 60 which is connected to the driving element **14*m* for driving a pawl 14*r* of the ratchet wheel 14 of the pulley 13 and the sensor 14*s* for detecting the position of the pawl 14*r*, the motor driving circuit 61 which is connected to the motor 21 for lifting the flase floor 3 and the sensor 24*a* of a detecting disc, and the fixing motor driving circuit 62 which is connected to the motor 29 of the wirerope fixing element 27 and the sensor 31*a* of a detecting disc, which are connected to the I/O port 54**.

Hereinafter, the operation of the lifting control circuit 50 will be described.

The CPU 51 is operated by program which is written in the ROM 52. The RAM 53 stores the value calculated in the CPU 51 and the value detected from the sensor **24*a*** of a detecting disc.

The CPU 51 calculates the present water level in accordance with the output signals of the sensor 59 for detecting the depth of water and the sensor **24*a* of a detecting disc to display it to the display part 57 of a control room and an operator monitors the information of the display part 57 and receives the height of the false floor 3 from the operating part 55**.

The inputted value applys from the I/O port 54 to the CPU 51 through the analog to digital converter 56.

The CPU 51 successively senses the detected signals of the sensor 59 for detecting the depth of water and the sensor **24*a* and after the motor driving circuit 61 starts to drive the motor 21 in the moving direction of the false floor 3 in accorance with the height of the false floor 3, it outputs the release signal of a wirelock to the fixing motor driving circuit 62. And then the fixing motor driving circuit 62 drives the motor 29** to release the wirerope fixing element, so that the wirerope becomes free.

Then, the pulley fixing control circuit 60 drives the driving element **14*m* to detach the pawl 14*r* of the ratchet wheel 14 and the sensor 14*s*** detects said operation.

The sensor **31*a* detects whether the release operation is fully carried out and outputs the response signal of switching to the CPU 51. The CPU 51 waits a stop of switching and outputs the driving signal to the lifting motor driving circuit 61 of each longitudinal grooves to drive the motor 21**.

The CPU 51 successively senses the signal from the sensor **24*a* and when the false floor is positioned to the desired height, it outputs the driving signal to the driving element 14*m* of the pulley fixing control circuit 60 in order to lock the pawl 14*r* on the ratchet wheel 14** of the pulley.

While the pulley is fixed, the CPU 51 outputs the wirelock signal to the fixing motor driving circuit 61 to drive the motor 29 and drives the wirerope fixing element 27 27 to fix the wirerope 16.

Figure 6:
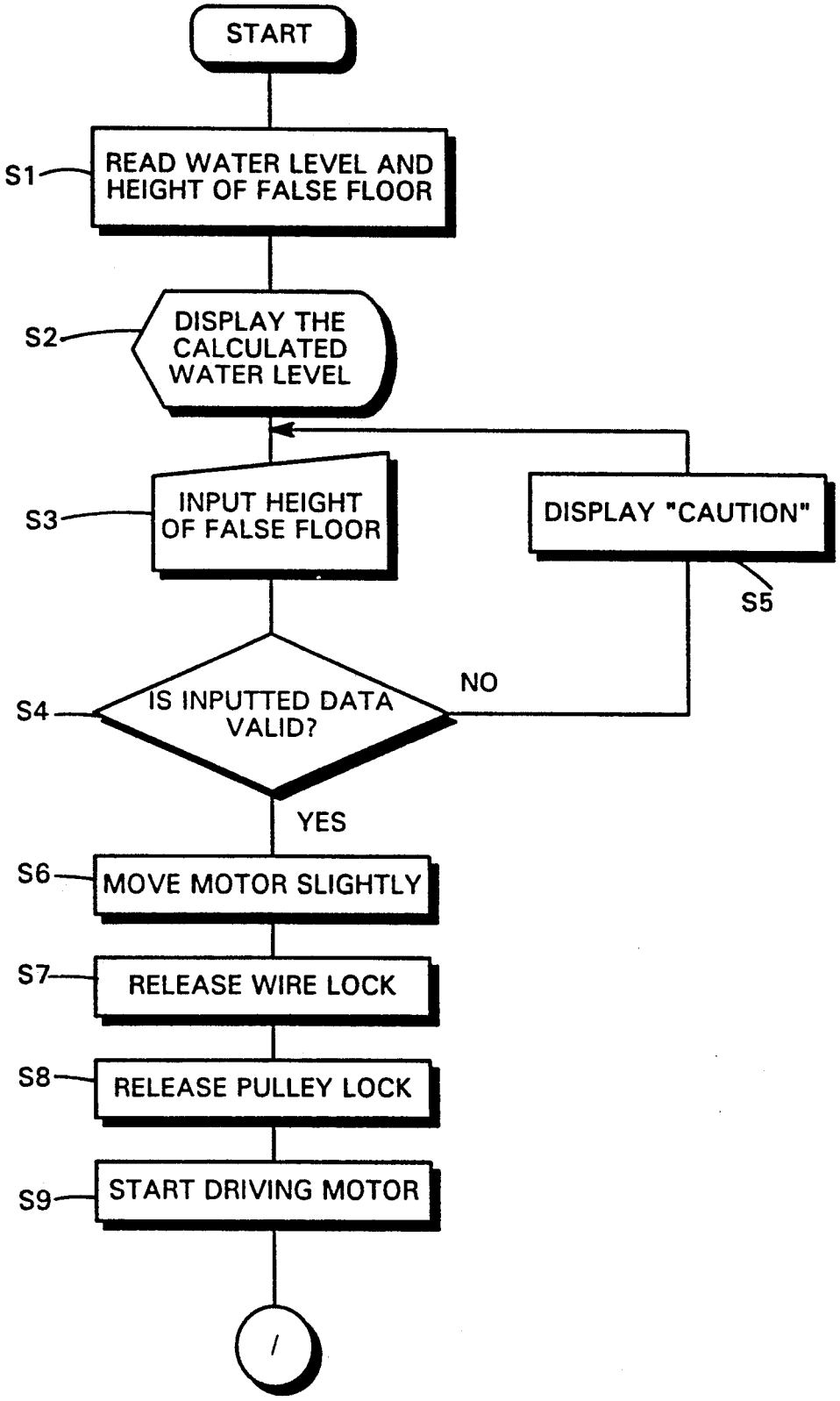
FIG. 6 and FIG. 7 are flow charts of the whole operation of a lifting apparatus.
Figure 7:
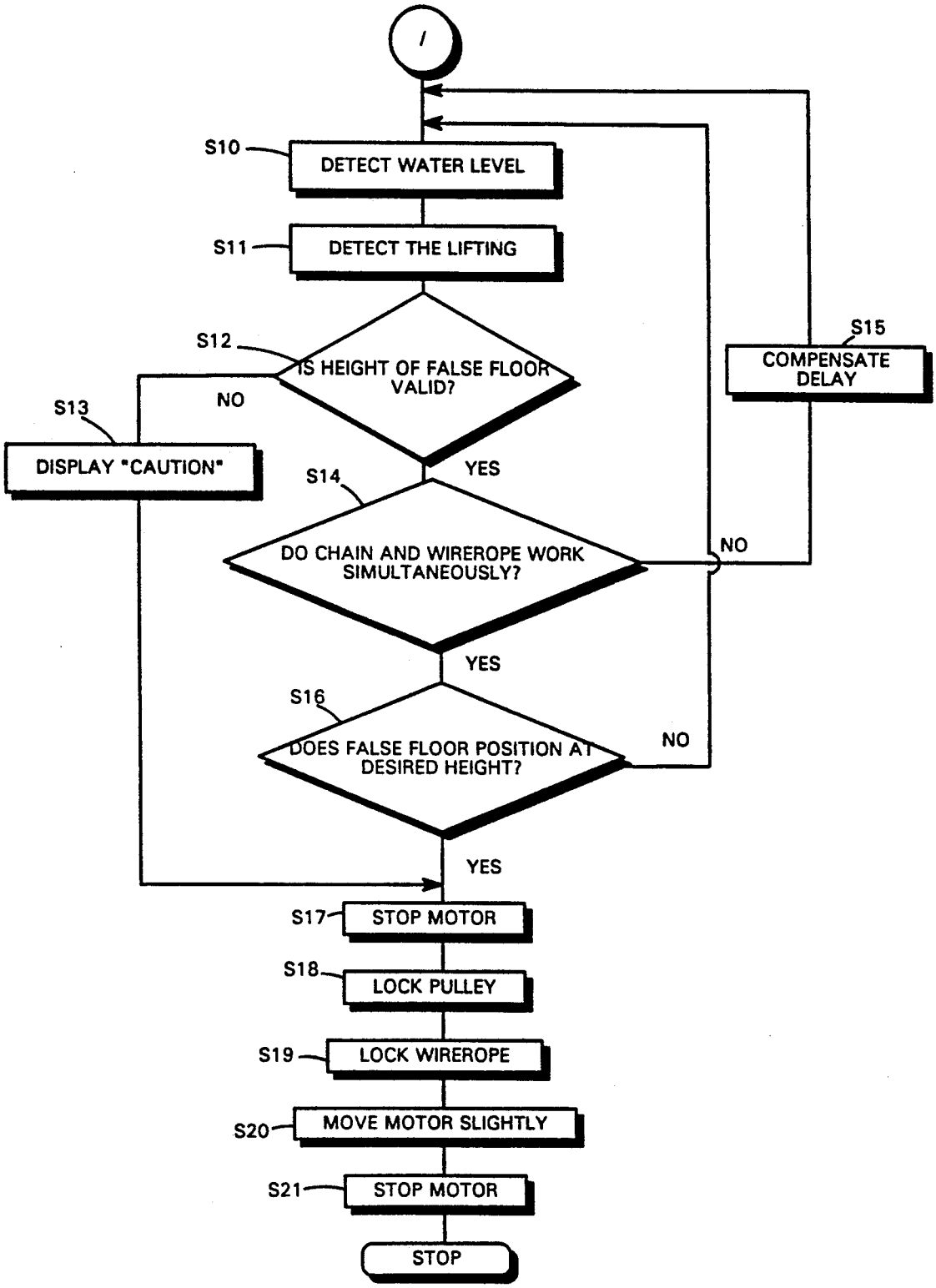

Hereinafter, the whole operation of a lifting apparatus according to the preferred embodiment of the present invention will be described in more detail with reference to the flow charts in FIG. 6 and FIG. 7.

The CPU 51 reads the present depth of water from the detected signal of the water level detecting sensor 59 and the height of the false floor from the detected value of the sensor **24*a* of each detecting disc (STEP 1**).

The CPU 51 calculates the difference between these values in order to calculate the depth of water which is the height from the present false floor to the surface of water and displays the present water level, the height of the false floor 3 and the depth of water to the display part 57 of a control room (STEP 2) and stores that values in the RAM 53.

And the CPU 51 inputs the height of the floor surface of the false floor which is adjusted to persons using the pool from the operating part 55 of a control room (STEP 3) and the CPU 51 compares the inputted height of the false floor 3 with the values stored in the RAM 53 in order to discriminate whether the height is within the controllable range or not (STEP 4). If the height is an invalid value, that is to say, if the false floor is exposed above the surface of the water, the CPU 51 displays "caution" through the display part 57 of a control room in order to notice the operator and again inputs the height (STEP 5). If the inputted value is reasonable, the CPU 51 releases the brake of the motor 21 in order to control that value and drives the motor 21 in the lifting direction of the false floor 3 (STEP 6) to move the chain.

In step 5, the chain is relaxed so that the tension is not given to the chain and the false floor is suspending above by the fixed wirerope. The quivering value of the motor 21 is previously designated and the CPU 51 senses the change of the detecting signal of the sensor **24*a* to quiver the motor 21**.

By this, the chain becomes taut with maintenance of the current height of the false floor 3 and the load given to the wirerope till now also is transfered to the chain.

Next, the CPU 51 drives the fixing motor driving circuit 62 and releases the wirerope fixing element to release the wirerope (STEP 7), and then the pulley fixing control circuit 60 releases the pawl of the ratchet wheel of the pulley to release the lock of the upper pulley (STEP 8), so that the wirerope becomes free to transfer the whole load of the false floor to the chain alone. The CPU 51 starts to control the lifting motor driving circuit 61 to drive the chain, thereby lifting the false floor to the height inputted in the step 3 (STEP 9).

When driving the motor, the CPU 51 continuously detects the depth of water (STEP 10) and senses the lifting state of the lifting units from the rotation state of the detecting sprocket by the sensor **24*a* (STEP 11) and discriminates whether the current height is in valid range or not (STEP 12**).

In the case where the water of the pool is drained or the false floor is exposed above the surface of the water during driving the motor, because the height of the false floor which is inputted in step 3 is invalid, the CPU 51 displays the "caution" to the display part 57 of a control room (STEP 13), stops the motor 21 to brake (STEP 17), drives the driving element **14*m*, locks the ratchet wheel 14 of the pulley 13, thereby fixing the pulley 13 in order to fix pulley (STEP 18), and drives the wirerope fixing element 27 (STEP 19**), thereby preventing the overload from giving to the chain.

In step 12, if the height of the false floor 3 is under the water, the CPU 51 discriminates from the detecting value of the sensor 24*a* of a detecting disc whether the false floor is lifting by simultaneously driving each lifting units or not, while keeping its horizontality (STEP 14). If there is a lifting unit which drives with a delay, the CPU 51 fast drives the motor 21 in order to compensate the delay (STEP 15) and then returns step 10.

In step 14, if the false floor is normally lifting by discriminating the driving state of each lifting units from the detecting value of each sensors 24*a*, the CPU 51 returns step 10 until the false floor is positioned at desired height (STEP 16). If the false floor is positioned at the desired height, the CPU 51 stops the motor to brake (STEP 17) and prevents the chain from falling no more by the load of the false floor 3.

And the CPU 51 locks the pawl of the ratchet wheel of the upper pulley (STEP 18) and then drives the wirerope fixing element to fix the wirerope (STEP 19).

In step 19, the false floor 3 is suspending by the fixed chain and wirerope. But, though the wirerope is fixed, the load is also given to the chain.

Therefore, after fixing the wirerope, the CPU 51 releases the brake of the motor 21 to quiver the motor 21 (STEP 20) and slightly moves the chain in descending direction of the false floor to relax and then brakes the motor 21 to stop (STEP 21).

The quivering value of the motor 21 is the previously designated value which is only for relaxing the chain. The CPU 51 senses the change of the detecting signal from the sensor 24*a* of the detecting disc to quiver the motor 21. Therefore, the floor is fixedly suspended by the wirerope under condition that the false floor is maintained that height and the load which given to the chain is now transferred to the wirerope. By this, the suspending load of the false floor can be transferred from the chain to the wirerope and the successive lifting operation of the false floor is carried out.

Though, in accordance with one preferred embidiment described above, the false floor in a pool is lifted as a whole, the false floor can be partitioned in order to selectively lift one or two parts thereof. In that case, the false floor can be partitioned for adult's and child's use and, accordingly, the number of the longitudinal grooves increases.

Furthermore, though the present invetnion winds the wirerope on an upper pulley one and half turns, it can sufficiently support the load of the flase floor only with a half turn winding in a small pool. The present invention installs the ratchet wheel to an upper pulley in order to fix the upper pulley in fixing the false floor, but it can sufficiently fix the false floor only by the wirerope fixing element without the ratchet wheel.

According to the above mentioned present invention, when lifting a false floor in the water, the lifting system simultaneously moves lifting units of each longitudinal grooves to make a false floor lift with the precise control by driving the chain while keeping its horizontality. At the desired height of a false floor, it fixes a wirerope placed in juxtaposition with the chain and relaxes the chain to support the load of a false floor with a wirerope, so that it prevents the tension weariness of the chain and can supports the load of a false floor with the tension of a wirerope alone when the water is drained in order to clear or to inspect a pool.

The tension given to the wirerope fixing element is not the entire load of a false floor. Because the upper pulley serves as the cushion for absorbing tension, the entire load of a false floor is not given to the wirerope fixing element and therefore, relatively low endurance is aceptable for the wirerop fixing element.

Thus, the chain is used for easily and precisely controlling a lifting of a false floor. Accordingly, for the present invention, the lifting operation is easily controlled by decentralizing the load of the wirerope fixing element, and in fixing, the tension load of the upper shaft of the pillar body was increased, so that the endurable tension of a wirerope fixing element may be not so large.

Moreover, since a plurality of fixing elements are used for fixing the wirerope and their loads by the false floor may be distributed to each elements, it is possible to compact the facility.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. An apparatus for lifting a false floor in a swimming pool in which a false floor is horizontally arranged and a plurality of longitudinal grooves are installed in the inside walls of a pool, and lifting units are installed in each longitudinal grooves to lift a false floor, which comprises characterized in that a pair of shafts of rotation movement which is installed at the top and bottom of a pillar body installed within each longitudinal grooves, a sprocket and a pulley which are placed in juxtaposition each other at each shafts of rotation movement to freely rotate; a chain which is suspended on a pair of sprockets, a wirerope which is suspended on a pair of pulleys, the chain and the wirerope being fixed to the arm of the false floor which is projected toward the longitudinal groove; a driving sprocket which is rotated by a motor to drive said chain which is engaged thereto, thereby lifting the false floor, and said wirerope being vertically moved in accordance with a lifting of the false floor and fixed by a wirerope fixing element to maintain the false floor during the stop of it.

2. An apparatus as claimed in claim 1, wherein a wirerope suspending for the false floor on an upper pulley of each longitudinal grooves is wound one and half turns from the pool side of a pulley groove and linked to a lower pulley through the wirerope fixing element, and said pulley groove of the upper pulley is V-shaped with a round bottom of which the diameter is somewhat larger than that of a wirerope, the depth is two times larger than the diameter of the wirerope, and the top width is two times larger than the diameter of said wirerope.

3. An apparatus as claimed in claim 1, wherein fixing means for stopping rotation movement is installed in the upper pulley.

4. An apparatus as claimed in claim 2, wherein fixing means for stopping rotation movement is installed in the upper pulley.

* * * * *